US005492166A

United States Patent [19]

Liu et al.

[11] Patent Number: 5,492,166

[45] Date of Patent: Feb. 20, 1996

[54] SHOT SLEEVE HAVING A PASSAGEWAY FOR FLUID FLOW

[75] Inventors: Joshua C. Liu, Murrysville; Ronald E. Boylstein, Pittsburgh; George C. Full, Murrysville; Eric D. Arndt, New Kensington; James R. Fields, Export, all of Pa.

[73] Assignee: Aluminum Company of America, Pittsburgh, Pa.

[21] Appl. No.: 350,345

[22] Filed: Dec. 6, 1994

[51] Int. Cl.[6] ..... B22D 17/04; B22D 41/005; B22D 46/00; B22D 2/00

[52] U.S. Cl. ..... 164/312; 164/113; 164/348; 164/458; 164/154.6

[58] Field of Search ..... 164/312, 113, 164/348, 458, 414, 455, 485, 443, 154.6

[56] References Cited

U.S. PATENT DOCUMENTS

| | | | |
|---|---|---|---|
| 3,664,411 | 5/1972 | Carver et al. . | |
| 4,623,015 | 11/1986 | Zeeman . | |
| 4,789,020 | 12/1988 | Motomura . | |
| 4,926,926 | 5/1990 | Zeeman . | |
| 5,012,856 | 5/1991 | Zeeman | 164/113 |
| 5,076,344 | 12/1991 | Fields et al. . | |
| 5,205,339 | 4/1993 | Perrella | 164/113 |
| 5,246,055 | 9/1993 | Fields et al. | 164/113 |
| 5,421,397 | 1/1995 | Hembree et al. | 164/348 |

FOREIGN PATENT DOCUMENTS

| | | | |
|---|---|---|---|
| 0278208 | 8/1988 | European Pat. Off. . | |
| 60-121045 | 6/1985 | Japan | 164/418 |

*Primary Examiner*—Richard K. Seidel
*Assistant Examiner*—I.-H. Lin
*Attorney, Agent, or Firm*—David V. Radack; Thomas R. Trempus

[57] ABSTRACT

The shot sleeve of the invention is used in a die casting machine and defines a bore for containing molten metal to be injected into a die. At least one passageway disposed generally parallel to the bore for containing a first fluid having a fluid temperature and a fluid flow rate is provided, whereby substantially uniform temperatures can be maintained across the width of the shot sleeve by controlling the fluid temperature of the fluid flow rate or both the fluid temperature and the fluid flow rate. A die casting machine and an associated method are also disclosed.

31 Claims, 3 Drawing Sheets

SHOT SLEEVE HAVING A PASSAGEWAY FOR FLUID FLOW

BACKGROUND OF THE INVENTION

This invention relates to an improved shot sleeve having at least one passageway for fluid flow, and more particularly, to a shot sleeve in which the temperature across the width thereof can be equalized by providing at least one passageway through which a fluid, having a controlled temperature and flow rate, passes.

Horizontal die casting machines use a horizontal charging chamber called a shot sleeve and a piston rod assembly to deliver molten metal under pressure to the die cavity. In most die casting machines, the shot sleeve is supported in the area of the die and press platen, leaving more than half its length unsupported. In the process of filling the shot sleeve with molten metal prior to injection, the molten metal charge accumulates on the bottom of the shot sleeve for a period lasting from typically 3 to 8 seconds. The molten metal fill percentage of the shot sleeve is maintained within a range of 30 to 70% by volume. This ratio of shot sleeve fill determines the amount of internal shot sleeve surface exposed to molten metal and thereby the rate of temperature change of this surface.

With unequal heating of the shot sleeve occurring, a steady state temperature gradient is reached between the top and the bottom of the shot sleeve. Since the shot sleeve is unsupported for a major portion of its length, the effect of this temperature gradient is a bowing of the shot sleeve in the longitudinal direction and an ovalizing of the diameter in the circumferential dimension. This distortion of the shot sleeve affects piston life as travel along the shot sleeve is not a straight line and clearance with the bore varies around the circumference requiring more clearance than desired to prevent galling. This additional clearance leads to flash generation at the die end with resultant early wear of the piston and shot sleeve and, in the case of vacuum die casting, entrance of contaminating gas at the fill end affecting metal and casting quality.

There have been suggested several "passive" methods of controlling temperature gradients, such as in U.S. Pat. No. 4,926,926 which discloses a three-layer shot sleeve in which a copper layer is welded onto a steel inner sleeve. A high yield strength outer layer is shrunk fit onto the intermediate copper layer in order to, according to the patent, act as a "mechanical straitjacket". The outer and inner steel layers are welded together at the two ends of the shot sleeve. European Patent Document EP-278,208 also shows an inner/outer shrunk fit bimetallic shot sleeve. Finally, Applicants' co-pending United States Patent Application (Attorney Docket No. 123177) discloses a shot sleeve having a thin steel inner layer surrounded by a thicker copper outer layer for effectively dissipating the heat through the shot sleeve in order to control temperature gradients.

Although some of these "passive" systems are effective, it is still desirable to more precisely control and make uniform the temperature gradients in the shot sleeve. U.S. Pat. No. 5,012,856 discloses providing a coolant conduit spaced above and away from the shot sleeve well area. The patent states that this avoids stress cracking and metal chilling problems.

Despite the existence of the shot sleeve disclosed in U.S. Pat. No. 5,012,856 there still remains a need for an effective and efficient shot sleeve that has means for providing uniformity of the temperatures across the width of the shot sleeve.

SUMMARY OF THE INVENTION

The shot sleeve of the invention has met the above-captioned need. The shot sleeve is used in a die casting machine and defines a bore for containing molten metal to be injected into a die. At least one passageway disposed generally parallel to the bore for containing a first fluid having a fluid temperature and a fluid flow rate is provided, whereby substantially uniform temperatures can be maintained across the width of the shot sleeve by controlling the fluid temperature or the fluid flow rate or both the fluid temperature and the fluid flow rate.

A die casting machine is also provided. The die casting machine comprises a molten metal supply means, a shot sleeve defining a bore for containing molten metal and at least one passageway disposed generally parallel to said bore for containing a first fluid, a piston operatively associated with the shot sleeve, and a die for receiving the molten metal injected from said the sleeve by the piston means.

Finally, an associated method of providing a uniform temperature across the width of a shot sleeve used in a die casting machine is also disclosed. The method comprises providing a shot sleeve defining a bore for containing molten metal and at least one passageway disposed generally parallel to the bore and introducing into the passageway a fluid having a temperature and flow rate. In this way, a uniform temperature across the width of the shot sleeve is maintained by controlling the temperature or flow rate or both the temperature and flow rate of the fluid.

BRIEF DESCRIPTION OF THE DRAWINGS

A full understanding of the invention can be gained from the following description of the preferred embodiment when read in conjunction with the accompanying drawings in which.

DETAILED DESCRIPTION

The improved shot sleeve of the invention is usable with any type of die casting machine. Although the following detailed description will focus on a vacuum die casting machine for use in casting aluminum parts, it will be appreciated that this description in no way limits the usage of the invention to this type of die casting machine, it being understood that the shot sleeve can be used with other types of die casting machines in which other metals are used for casting different types of parts. Such other die casting machines include, but are not limited to, nonvacuum-type casters where the molten metal is supplied through a pour hole located in the top of the sleeve and any caster with a nonhorizontal-type shot sleeve.

Figure 1:
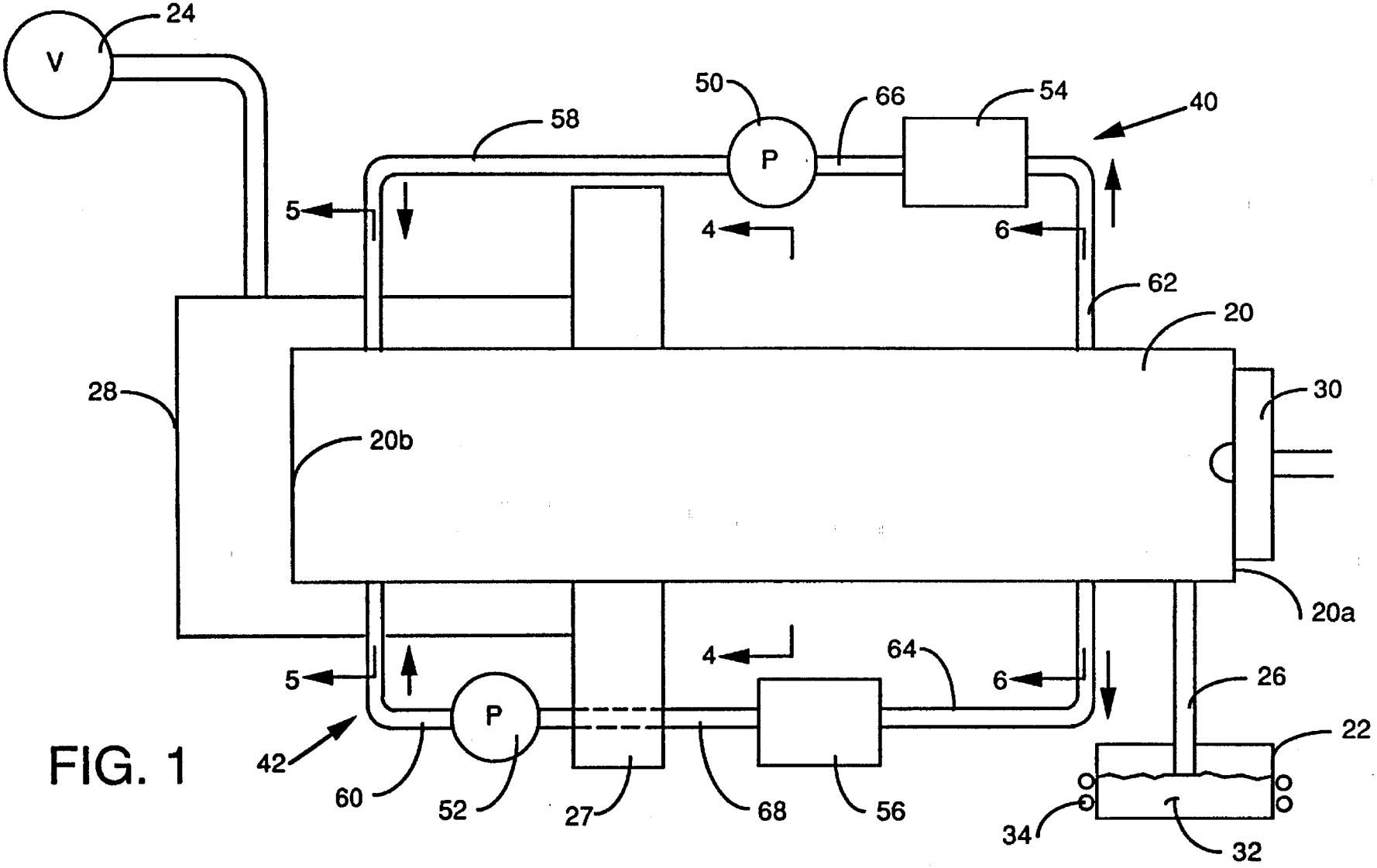
FIG. 1 is a schematic diagram of a vacuum die casting machine showing the control system of the invention.

Referring to FIG. 1, a schematic diagram of a vacuum die casting system is shown. The system comprises the shot sleeve 20 of the invention, a molten metal, such as molten aluminum, reservoir 22, a vacuum 24 and a siphon tube 26. The shot sleeve 20 is supported in a horizontal position by a support platen 27. The shot sleeve 20 is inserted in a die 28 in the shape of a casting to be made in the vacuum die casting process. The shot sleeve 20 has disposed therein a movable piston 30. The shot sleeve 20, therefore, has a piston end 20*a* and die end 20*b*. Typical cast aluminum parts that can be made are automotive parts, such as frame parts (cast nodes, strut towers, front end and rear end joints) and body parts (body and door parts) or any casting requiring structural integrity.

The process of making a vacuum die casting includes providing a molten metal 32 in the reservoir 22. The molten metal 32 which can be, for example, an aluminum alloy, can come from a holding furnace, for example. The molten metal 32 is maintained at a casting temperature which depends on the alloy to be cast. This temperature is maintained by using a resistance heater 34, for example.

The molten metal 32 is drawn through the siphon tube 26 when a vacuum is created by the vacuum means 24. The molten metal 32 travels through the siphon tube 26 into the shot sleeve 20. The amount of molten metal drawn into the shot sleeve 20 depends on the part being die cast. However, the total amount of molten metal drawn into the shot sleeve should take no longer than about 3 to 8 seconds to travel from the reservoir 22 into the shot sleeve 20. This will reduce freezing of the molten metal 32 in the siphon tube 26.

Once the proper amount of molten metal is deposited into the shot sleeve 20, the piston 30 is moved to inject the molten metal into the die 28. The piston stroke comprises initially a relatively slow movement to reduce entrapping gas in the metal and then a rapid acceleration to inject the metal into the die 28.

For a more detailed discussion of a vacuum die casting machine, see U.S. Pat. Nos. 5,076,344 and 5,246,055, the disclosures of which are expressly incorporated by reference herein.

The improved shot sleeve further consists of a first control system 40 and substantially identical second control system 42. Each control system provides a closed loop for circulating a fluid, preferably oil, through passageways defined by the outer portion of the shot sleeve, as will be discussed with respect to FIGS. 2–6. Each control system consists of a pump 50 and 52 and a heat exchanger 54 and 56. The pump 50, 52 forces the fluid into an inlet tube 58,60, through the shot sleeve 20, out an outlet tube 62, 64, and into the heat exchanger 54, 56 where the temperature of the fluid is adjusted. The fluid then flows into a connecting tube 66, 68 to again be pumped through the pump 50, 52 and into the shot sleeve 20. A specific circulating oil temperature control system which acts as the pump 50, 52 and heat exchanger 54, 56 in one unit is one made by Mokon of Buffalo, N.Y., Model No. HC4G24. This model has two horsepower, 20 gallon per minute maximum flow rate up to 100 psi and a two zone control with 24 kw heater having an operating range from 100° F. to 500° F. The pump 50, 52 is preferably adjusted to pump from about two to ten gallons per minute, and most preferably about six gallons per minute.

As mentioned above, the fluid used is preferably oil such as that sold under the trade name THERMINOL 66 by Monsanto. This particular brand has a kinematic viscosity of 300 st. and an optimum temperature range from 200° F. to 650° F. It will be appreciated that other fluids, such as water can be used.

The heat exchanger 54, 56 can control the temperature of the oil in a range of 80° F. to 500° F. Preferably, the temperature of the oil as it flows through the shot sleeve is between about 200° F. to 400° F. The oil temperature will rise only a few degrees in temperature after exiting the shot sleeve due to its high volume flow rates and the fairly low heat flux from the molten metal inside the shot sleeve during casting.

Referring now to FIGS. 2–6, the fluid flow through the shot sleeve 20 will be discussed in detail. The shot sleeve 20 defines a bore 100 (FIGS. 4–6) into which the molten metal 32 is introduced and subsequently injected into the die 28 by the piston assembly 30. The control system consists of a plurality of passageways disposed generally parallel to the shot sleeve 20. The oil flowing through the passageways helps to control the temperature of the shot sleeve 20 so that a uniform temperature across the width of the shot sleeve is maintained.

Figure 2:
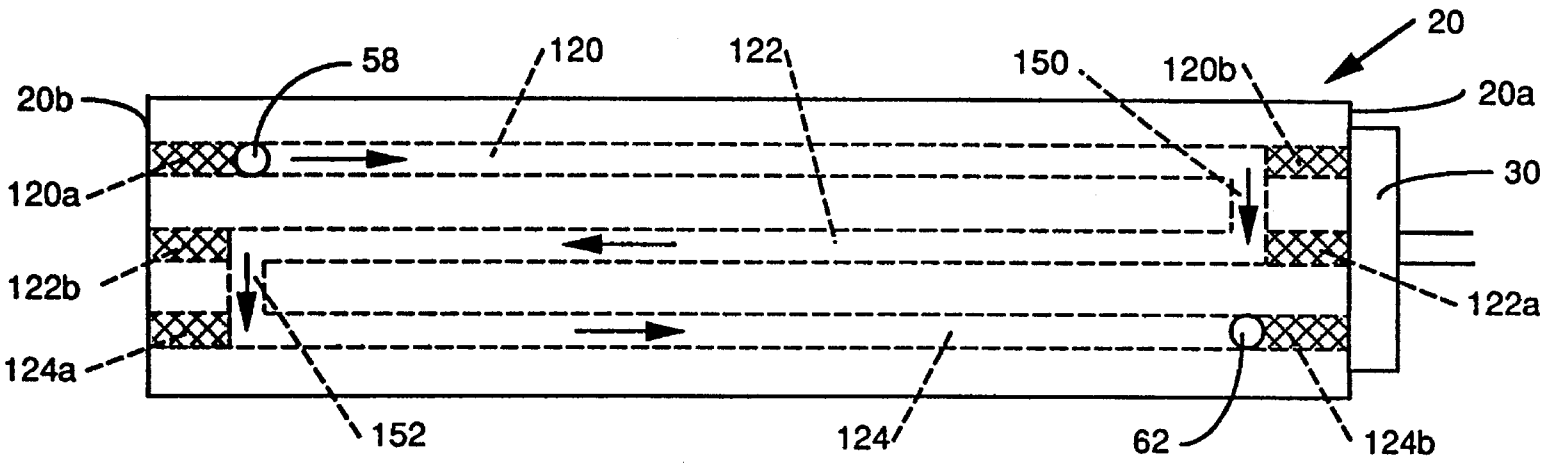
FIG. 2 is a top plan view of the shot sleeve, showing three passageways in phantom line drawing.

FIG. 2 shows a top plan view of the shot sleeve 20, showing three passageways 120, 122, 124 (in phantom line drawing) disposed in the upper section of the shot sleeve 20 extending from the piston end 20*a* of the shot sleeve 20 to the die end 20*b* of the shot sleeve 20. These passageways 120, 122 and 124 are preferably circular in cross-section, and have a diameter of about ⅛ to ½ inches. The passageways 120, 122, 124 are disposed radially from the bore 100 with about ⅛ to ⅜ of an inch. (See distances D1, D2, D3 on FIG. 4.)

Figure 3:
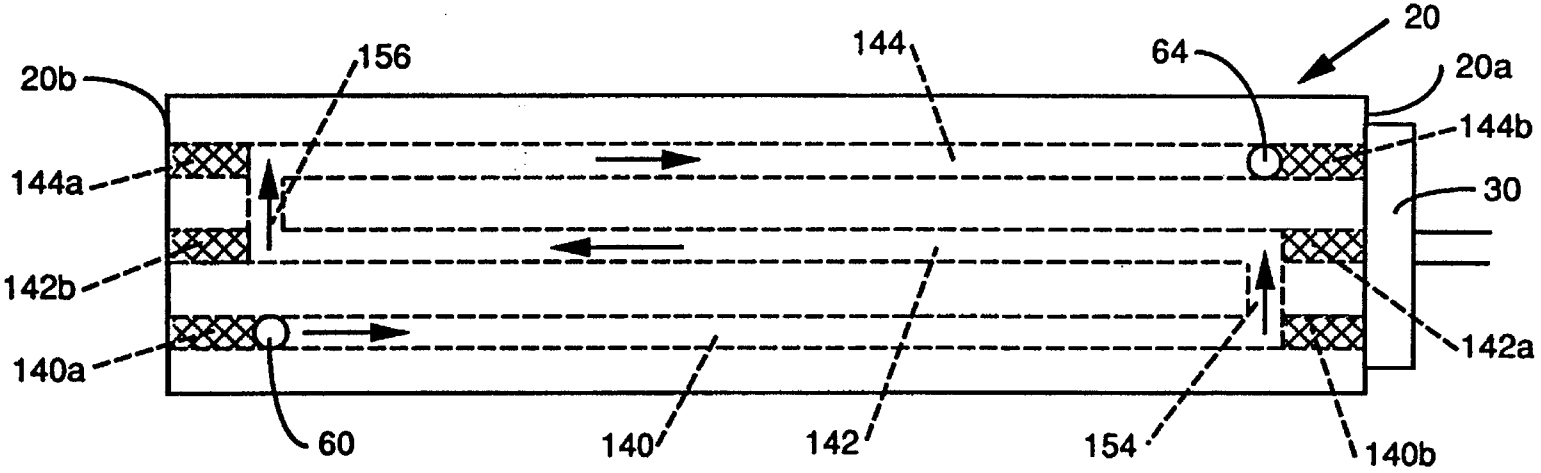
FIG. 3 is a bottom plan view of the shot sleeve, showing three passageways in phantom line drawing.
Figure 4:
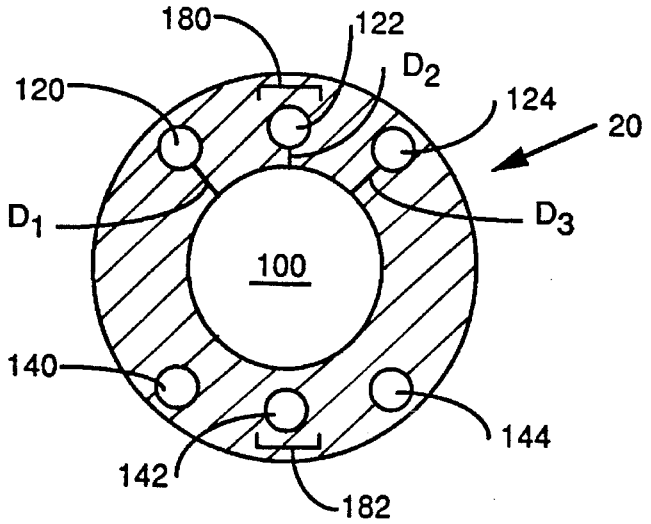
FIG. 4 is a cross-sectional view taken along line 4—4 of FIG. 1.
Figure 5:
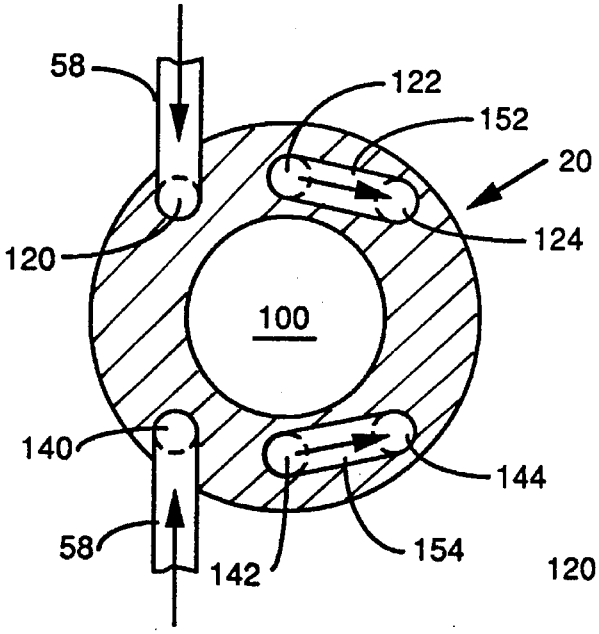
FIG. 5 is a cross-sectional view taken along line 5—5 of FIG. 1.
Figure 6:
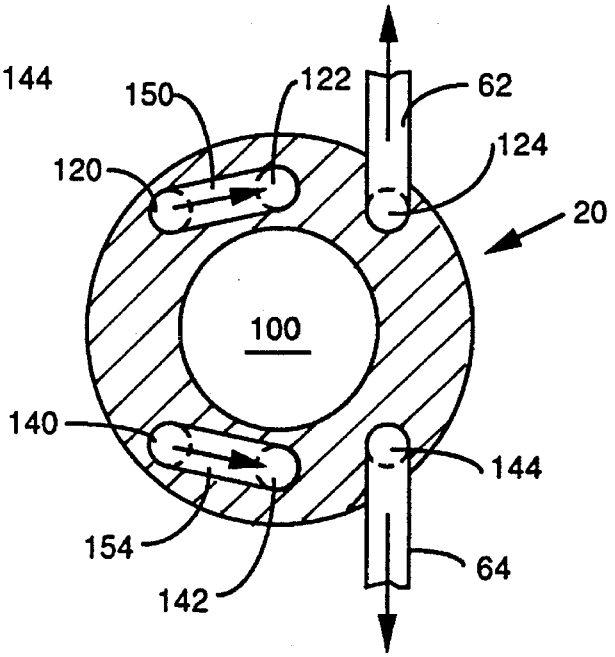
FIG. 6 is a cross-sectional view taken along line 6—6 of FIG. 1.

Similarly, FIG. 3 shows a bottom plan view of the shot sleeve 20, showing three passageways 140, 142 and 144 extending from the piston end 20*a* of the shot sleeve 20 to the die end 20*b* of the shot sleeve 20. These passageways 140, 142 and 144 are similar in dimension and positioning as passageways 120, 122 and 124 discussed above.

The passageways 120, 122, 124 and 140, 142, 144 are created by boring holes through the entire length of the shot sleeve 20, as shown in FIGS. 2 and 3. The plugs 120*a*, 120*b*, 122*a*, 122*b*, 124*a*, 124*b* and 140*a*, 140*b*, 142*a*, 142*b*, 144*a*, 144*b* are placed at the ends of the passageways in order to create a balanced length of passageway for symmetrical heating or cooling.

Referring now to all FIGS. 2–6, the flow of the oil through the passageways will be discussed. It will be appreciated that passageways 120, 122 and 124 are part of the first control system 40 and that passageways 140, 142, 144 are part of the second control system 42. Thus, the oil in the first control system 40 remains separated from the molten metal 32 in the bore 100 as well as the oil in the second control system 42.

Referring particularly to FIGS. 2 and 4–6, the flow of the oil through the first control system 40 comes from the pump 50 into inlet tube 58 and then into passageway 120. Passageway 120 includes a plug 120*a* to prevent the oil from flowing out of the passageway 120 and thus out of the die end 20*b* of the sleeve 20. The oil then flows through passageway 120 into channel 150 which links passageway 120 with passageway 122. A second plug 120*b* is placed in passageway 120 to prevent the oil from flowing out of the piston end 20*a* of the sleeve 20, as well as a plug 122*a* in passageway 122 to prevent oil from flowing out of the piston end 20*a*. The oil then flows from channel 150 into passageway 122.

Once the oil reaches die end 20*b* of the sleeve 20 in passageway 122, it is directed into channel 152 by means of plug 122*b* and 124*a* and then into passageway 124. The oil is then stopped by plug 124*b* from flowing out of passageway 124 of piston end 20*a*. The oil then flows out of passageway 124 into outlet tube 62 for introduction into the heat exchanger 54 where the temperature of the oil is adjusted for recirculation through the first control system 40.

Referring now more particularly to FIGS. 3–6, the flow of oil through the second control system 42 comes from pump 52 into inlet tube 60 and then into passageway 140. Passageway 140 includes a plug 140*a* to prevent the oil from flowing out of the passageway 140 and thus out of the die end 20*b* of the sleeve 20. The oil then flows through passageway 140 into channel 154 which links passageway 140 to passageway 142. A second plug 140*b* is placed in passageway 140 to prevent the oil from flowing out of the piston end 20*a* of the sleeve 20 as well as a plug 142*a* in the passageway 142 to prevent oil from flowing out of the piston end 20*a* of sleeve 20. The oil flows from channel 154 into passageway 142.

Once the oil reaches the die end 20*b* of the sleeve 20 in passageway 142, it is directed into channel 156 by means of a plug 142*b* and plug 144*a* and then into passageway 144 at piston end 20*a*. The oil is then stopped by plug 144*b* from flowing out the passageway 144. The oil then flows out of passageway 144 into outlet tube 64 for introduction into heat exchanger 56 where the temperature of the oil is adjusted for recirculation through the second control system 42.

Although much attention has been focussed on the specific embodiment of two control systems, one for the upper half of the sleeve and the other for the lower half of the sleeve, with each system having three passageways, it will be appreciated that there are numerous variations of this system that fall within the scope of the invention. For example, one control system having anywhere from one to as many as ten or more passageways can be provided. Multiple control systems can also be provided. The key concept of the invention is to provide a passageway which is generally parallel to the shot sleeve bore which is adapted to contain a fluid. The temperature or the flow rate or both the temperature and flow rate of the fluid can be controlled in order to provide entirely uniform shot sleeve temperatures across the width of the shot sleeve and thus reduce to a bare minimum the moderate temperature gradients in the shot sleeve. This will provide a distortion-free shot sleeve except for uniform circumferential thermal expansion. This will result in extending the useful life of the shot sleeve as well as providing higher quality cast parts.

In order to equalize the temperature across the width of the sleeve, however, it is preferred to heat around the upper section of the sleeve 20 and provide cooling near the bottom of the sleeve 20. This is because the molten metal fill percentage in the bore is usually about 30%–70%, thus causing hotter temperatures at the bottom of the bore 100 than at the top of the bore. We have found that an optimum constant temperature throughout the entire shot sleeve is 450° F. This temperature can be achieved by providing a range of 2–10 gpm and 100° F. to 500° F. for the oil flow rate and temperature.

Referring again to FIG. 4, thermocouples, such as thermocouples 180, 182 can be provided in the shot sleeve 20 to monitor the temperature of the oil. The thermocouples are connected to a meter (not shown) which indicates the temperature of the shot sleeve 20. These temperature indications can be used to adjust the temperature and flow rate of the oil and thus control the temperature of the shot sleeve near the bore and throughout the width thereof, so as to resist undesired temperature gradients and to aid in maintaining a uniform temperature across the width of the shot sleeve.

The shot sleeve 20 of the invention has a further advantage in that preheating of the shot sleeve 20 prior to die casting can minimize the time required to reach the steady state shot sleeve temperature during die caster start-up. This will reduce the number of scrap parts that were created with the so-called "passive" shot sleeve designs.

It will be appreciated that a distortion-free "active" shot sleeve design has been disclosed which enables the shot sleeve to achieve a steady state temperature throughout its width. Because thermal gradients are removed, the shot sleeve has no distortion and thus, can have a longer useful life and can produce higher quality cast parts.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A shot sleeve for use in a die casting machine, said shot sleeve defining a bore for containing molten metal to be injected into a die and said shot sleeve including at least one passageway disposed generally parallel to said bore for containing a first fluid having a first fluid temperature and a first fluid flow rate, whereby substantially uniform temperatures can be maintained across the width of said shot sleeve by controlling said first fluid temperature or said first fluid flow rate or both said first fluid temperature and said first fluid flow rate in said passageway.

2. The shot sleeve of claim 1, including a first control system operatively associated with a first said passageway for controlling said first fluid temperature or said first fluid flow rate or both said first fluid temperature and said first fluid flow rate in said first passageway.

3. The shot sleeve of claim 2, wherein said first control system includes (i) a first thermocouple disposed in said shot sleeve; (ii) a first pump for pumping said first fluid through said first passageway and for controlling said first fluid flow rate; and (iii) a first heat exchanger for receiving said first fluid after it has passed through said first passageway and for controlling said first fluid temperature.

4. The shot sleeve of claim 3, including a second said passageway disposed generally parallel to said first passageway; and a first channel connecting said first passageway to said second passageway so that said first fluid can flow from said first pump into said first passageway, into and through said first channel and then through and out of said second passageway to said first heat exchanger.

5. The shot sleeve of claim 4, including a third said passageway disposed generally parallel to said first passageway and said second passageway; and a second channel connecting said second passageway to said third passageway so that said first fluid can flow from said first pump into said first passageway, into and through said first channel, through said second passageway, into and through said second channel and through and out of said third passageway to said first heat exchanger.

6. The shot sleeve of claim 5, wherein said shot sleeve is used in a horizontal die casting machine and said shot sleeve has an upper section and a lower section;

said first, second and third passageways are disposed in said upper section; and said first thermocouple is disposed in said upper section.

7. The shot sleeve of claim 6, including a fourth said passageway disposed generally parallel to said first, second and third passageway, said fourth passageway containing a second fluid having a second fluid temperature and a second fluid flow rate; and a second control system operatively associated with said fourth passageway for controlling said second fluid temperature or said second fluid flow rate or both said second fluid temperature and said second fluid flow rate in said fourth passageway.

8. The shot sleeve of claim 7, including said second control system includes (i) a second thermocouple disposed in said shot sleeve; (ii) a second pump for pumping said second fluid through said fourth passageway and for controlling said second fluid flow rate; and (iii) a second heat exchanger for receiving said second fluid after it has passed through said fourth passageway and for controlling said second fluid temperature.

9. The shot sleeve of claim 8, including a fifth said passageway disposed generally parallel to said fourth passageway; and a third channel connecting said fourth passageway to said fifth passageway so that said second fluid can flow from said second pump into said fourth passageway, into and through said third channel and then through and out of said fifth passageway to said second heat exchanger.

10. The shot sleeve of claim 9, including a sixth said passageway disposed generally parallel to said fourth passageway and said fifth passageway; and a fourth channel connecting said fifth passageway to said sixth passageway so that said second fluid can flow from said second pump into said fourth passageway, into and through said third channel, through said fifth passageway, into and through said fourth channel and through and out of said sixth passageway to said second heat exchanger.

11. The shot sleeve of claim 10, wherein said fourth, fifth and sixth passageways are disposed in said lower section; and said second thermocouple is disposed in said lower section.

12. A die casting machine comprising:

molten metal supply means;

a shot sleeve defining a bore for containing molten metal, said shot sleeve including at least one passageway disposed generally parallel to said bore for containing a first fluid having a first fluid temperature and a first fluid flow rate, whereby substantially uniform temperatures can be maintained across the width of said shot sleeve by controlling said first fluid temperature or said first fluid flow rate or both said first fluid temperature and said first fluid flow rate;

a piston operatively associated with said shot sleeve; and a die for receiving said molten metal injected from said shot sleeve by said piston means.

13. The shot sleeve of claim 12, including a first control system operatively associated with a first said passageway for controlling said first fluid temperature or said first fluid flow rate or both said first fluid temperature and said first fluid flow rate in said first passageway.

14. The shot sleeve of claim 13, wherein said first control system includes (i) a first thermocouple disposed in said shot sleeve; (ii) a first pump for pumping said first fluid through said first passageway and for controlling said first fluid flow rate; and (iii) a first heat exchanger for receiving said first fluid after it has passed through said first passageway and for controlling said first fluid temperature.

15. The shot sleeve of claim 14, including a second said passageway disposed generally parallel to said first passageway; and a first channel connecting said first passageway to said second passageway so that said first fluid can flow from said first pump into said first passageway, into and through said first channel and then through and out of said second passageway to said first heat exchanger.

16. The shot sleeve of claim 15, including a third said passageway disposed generally parallel to said first passageway and said second passageway; and a second channel connecting said second passageway to said third passageway so that said first fluid can flow from said first pump into said first passageway, into and through said first channel, through said second passageway, into and through said second channel and through and out of said third passageway to said first heat exchanger.

17. The shot sleeve of claim 16, wherein said shot sleeve is used in a horizontal die casting machine and said shot sleeve has an upper section and a lower section;

said first, second and third passageways are disposed in said upper section; and said first thermocouple is disposed in said upper section.

18. The shot sleeve of claim 17, including a fourth said passageway disposed generally parallel to said first, second and third passageway, said fourth passageway containing a second fluid having a second fluid temperature and a second fluid flow rate; and a second control system operatively associated with said fourth passageway for controlling said second fluid temperature or said second fluid flow rate or both said second fluid temperature and said second fluid flow rate in said fourth passageway.

19. The shot sleeve of claim 18, including said second control system includes (i) a second thermocouple disposed in said shot sleeve; (ii) a second pump for pumping said second fluid through said fourth passageway and for controlling said second fluid flow rate; and (iii) a second heat exchanger for receiving said second fluid after it has passed through said fourth passageway and for controlling said second fluid temperature.

20. The shot sleeve of claim 19, including a fifth said passageway disposed generally parallel to said fourth passageway; and a third channel connecting said fourth passageway to said fifth passageway so that said second fluid can flow from said second pump into said fourth passageway, into and through said third channel and then through and out of said fifth passageway to said second heat exchanger.

21. The shot sleeve of claim 20, including a sixth said passageway disposed generally parallel to said fourth passageway and said fifth passageway; and a fourth channel connecting said fifth passageway to said sixth passageway so that said second fluid can flow from said second pump into said fourth passageway, into and through said third channel, through said fifth passageway, into and through said fourth channel and through and out of said sixth passageway to said second heat exchanger.

22. The shot sleeve of claim 21, wherein said fourth, fifth and sixth passageways are disposed in said lower section; and said second thermocouple is disposed in said lower section.

23. A method of providing a uniform temperature across the width of a shot sleeve used in a die casting machine, said method comprising:

providing said shot sleeve defining a bore for containing molten metal, said shot sleeve including at least one passageway disposed generally parallel to said bore; and introducing into said passageway a first fluid having a first fluid temperature and a first fluid flow rate, whereby a uniform temperature across the width of the shot sleeve is maintained by controlling said first fluid temperature or said first fluid flow rate or both said first fluid temperature and said first fluid flow rate.

24. The method of claim 23, including providing at least one passageway in an upper section of said shot sleeve for containing said first fluid; and providing at least one passageway in a lower section of said shot sleeve for containing a second fluid having a second fluid temperature and a second fluid flow rate.

25. The method of claim 24, including determining the temperature of said upper section;

determining the temperature of said lower section; and controlling said first fluid temperature or said first fluid flow rate or both said first fluid temperature and said first fluid flow rate and said second fluid temperature or said second fluid flow rate or both said second fluid temperature and said second fluid flow rate in order to generally equalize said temperature of said upper section of said shot sleeve and said temperature of said lower section of said shot sleeve.

26. The method of claim 25, including said first fluid temperature is between about 800° F. to 500° F.

27. The method of claim 25, including said second fluid temperature is between about 80° F. to 500° F.

28. The method of claim 25, including said first fluid flow rate is between about 2–10 gallons per minute.

29. The method of claim 25, including said second fluid flow rate is between about 2–10 gallons per minute.

30. The method of claim 25, including employing oil as said first fluid.

31. The method of claim 25, including employing oil as said second fluid.

* * * * *

UNITED STATES PATENT AND TRADEMARK OFFICE

CERTIFICATE OF CORRECTION

PATENT NO. : 5,492,166

DATED : February 20, 1996

INVENTOR(S) : Joshua C. Liu et al.

It is certified that error appears in the above-indentified patent and that said Letters Patent is hereby corrected as shown below:

Col. 10, claim 26, line 2 Change 800 to 80

Signed and Sealed this

Fourth Day of March, 1997

*Attest:*

Bruce Lehman

BRUCE LEHMAN

*Attesting Officer*

*Commissioner of Patents and Trademarks*